United States Patent [19]

Diehl et al.

[11] Patent Number: 4,950,586

[45] Date of Patent: Aug. 21, 1990

[54] SOLID PARTICLE DISPERSIONS OF FILTER DYES FOR PHOTOGRAPHIC ELEMENTS

[75] Inventors: Donald R. Diehl; Ronda E. Factor, both of Rochester, N.Y.

[73] Assignee: Eastman Kodak Company, Rochester, N.Y.

[21] Appl. No.: 290,601

[22] Filed: Dec. 23, 1988

[51] Int. Cl.[5] ..... G03C 1/00

[52] U.S. Cl. ..... 430/507; 430/512; 430/517

[58] Field of Search ..... 430/507, 512, 517

[56] References Cited

U.S. PATENT DOCUMENTS 4,092,168 5/1978 Lemahieu et al. .

4,294,916 10/1981 Postle et al. .

4,294,917 10/1981 Postle et al. .

4,420,555 12/1983 Krueger et al. .

*Primary Examiner*—Paul R. Michl

*Assistant Examiner*—Thorl Chea

*Attorney, Agent, or Firm*—Paul L. Marshall

[57] ABSTRACT

Solid particle dispersions of dyes according to the formula:

are useful as filter dyes in photographic elements.

In this formula, n is 0 or 1. $R_1$ and $R_2$ are each independently substituted or unsubstituted alkyl or substituted or unsubstituted aryl, or taken together with $R_6$, $R_7$, N and the atoms to which they are attached, represent the atoms necessary to complete a julolydyl ring.

$R_3$ is H, substituted or unsubstituted alkyl, or substituted or unsubstituted aryl.

$R_4$ and $R_5$ each independently represents H, substituted or unsubstituted alkyl, substituted or unsubstituted aryl, secondary or tertiary amino, $CO_2H$, or $NHSO_2R_8$, with the proviso that at least one of $R_4$ and $R_5$ or a substituted on an aryl ring in $R_4$ and $R_5$ is $CO_2H$ or $NHSO_2R_8$. $R_8$ is substituted or unsubstituted alkyl or substituted or unsubstituted aryl.

$R_6$ and $R_7$ independently represents H, or $R_7$ taken together with $R_2$, or $R_6$ taken together with $R_1$, represent the atoms necessary to complete a heterocyclic ring.

10 Claims, No Drawings

SOLID PARTICLE DISPERSIONS OF FILTER DYES FOR PHOTOGRAPHIC ELEMENTS

FIELD OF THE INVENTION

This invention relates to dyes, particularly dyes useful as filter dyes, especially in photographic elements.

BACKGROUND OF THE INVENTION

Photographic materials often contain filter dyes to absorb light from different regions of the spectrum, such as red, blue, green, ultraviolet, and infrared, to name a few. These filter dyes are often required to perform the function of absorbing light during exposure of the material so as to prevent or at least inhibit light of a region of the spectrum from reaching at least one of the radiation-sensitive layers of the element.

After processing of the element, however, the continued presence of the filter dye will adversely affect the image quality of the photographic material. It is therefore desirable to use filter dyes that will be solubilized and removed or at least decolorized during photographic processing. Dyes that are easily solubilized, however, tend to wander throughout the photographic material during coating, adversely affecting the final image quality.

To prevent dye wandering, the dyes are often coated with a mordant to bind the dye in the layer in which it is coated. Dye mordants, while often useful, tend to either bind the dye too strongly, inhibiting solubilization of the dye during photographic processing, or too weakly, thus not preventing dye wandering.

U.S. Pat. No. 4,420,555 describes phenylsulfonamido substituted benzoyl acetonitrile arylidene yellow filter dyes dispersed in polymeric latex particles that are useful as yellow filter dyes in photographic elements. It is still desirable, however, to provide filter dyes that have even greater effectiveness at filtering light in photographic elements.

It would therefore be highly desirable to provide a filter dye for use in photographic elements that does not wander during coating, is fully solubilized during processing, does not require a mordant or latex particles &o incorporate it in a layer of a photographic element, and is decolorized on processing.

SUMMARY OF THE INVENTION

According to the invention, &here is provided a photographic element having a layer comprising a hydrophilic binder and, as a filter dye, a solid particle dispersion of a compound having the formula:

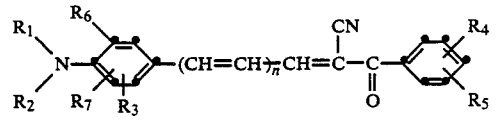

In this formula, n is 0 or 1. $R_1$ and $R_2$ are each independently substituted or unsubstituted alkyl or substituted or unsubstituted aryl, or taken together with $R_6$, $R_7$, N, and the atoms to which they are attached, represent the atoms necessary to complete a julolydyl ring.

$R_3$ is H, substituted or unsubstituted alkyl, or substituted or unsubstituted aryl.

$R_4$ and $R_5$ each independently represents H, substituted or unsubstituted alkyl, substituted or 5 unsubstituted aryl, secondary or tertiary amino, $CO_2H$, or $NHSO_2R_8$, with the proviso that at least one of $R_4$ and $R_5$ or a substituent on an aryl ring in $R_4$ or $R_5$ is $CO_2H$ or $NHSO_2R_8$. $R_8$ is substituted or unsubstituted alkyl or substituted or unsubstituted aryl.

$R_6$ and $R_7$ each independently represents H, or $R_7$ taken together with $R_2$, or $R_6$ taken together with $R_1$, represent the atoms necessary to complete a heterocyclic ring.

Solid particle dispersions of the compound of formula (I) are useful as general purpose filter dyes, alone or in combination with other filter dyes in photographic elements. They are insoluble at coating pH's of 6 or less (generally 4 to 6) and soluble at processing pH's of 8 or more (generally 8 to 12), so that they do not interact with other components of the photographic element, yet still are fully solubilized during photographic processing.

DESCRIPTION OF THE PREFERRED EMBODIMENTS

According to formula (I), $R_1$, $R_2$, $R_3$, $R_4$, $R_5$, and $R_8$ may each be substituted or unsubstituted alkyl or substituted or unsubstituted aryl, preferably substituted or unsubstituted alkyl of 1 to 6 carbon atoms or substituted or unsubstituted aryl of 6 to 12 carbon atoms. The alkyl or aryl groups may be substituted with any of a number of substituents as is known in the art, other than those, such as sulfo substituents, that would tend to increase the solubility of the dye so much as to cause it to become soluble at coating pH's. Examples of useful substituents include halogen, alkoxy, ester groups, amido, acyl, and alkylamino. Examples of alkyl groups include methyl, ethyl, n-propyl, isopropyl, n-butyl, isobutyl, n pentyl, n-hexyl, or isohexyl. Examples of aryl groups include phenyl, naphthyl, anthracenyl, pyridyl, and styryl. $R_6$ and $R_1$, or $R_7$ and $R_2$ may form a heterocyclic ring, preferably a 5- to 6-membered ring (e.g., piperadinyl)

Examples of dyes according to formula (I) include the following:

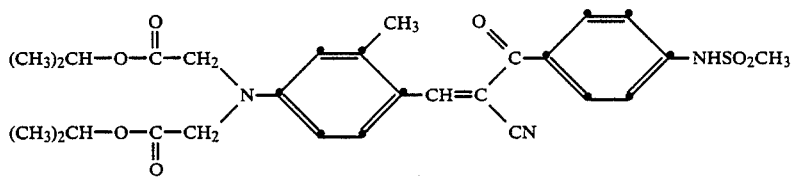

(1)

-continued
(2)
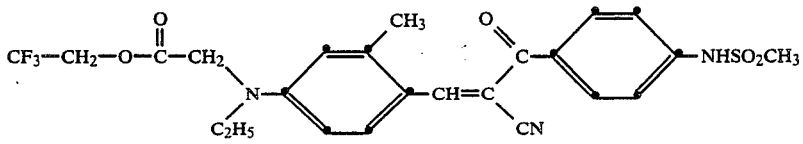
(3)
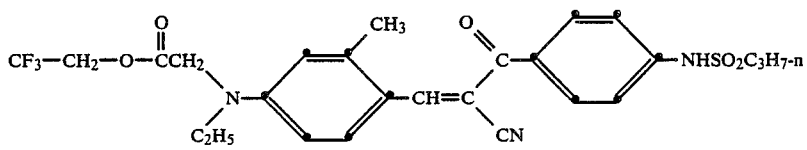
(4)
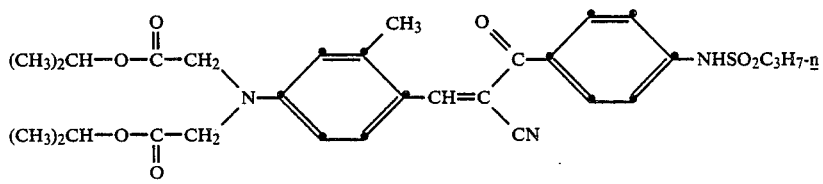
(5)
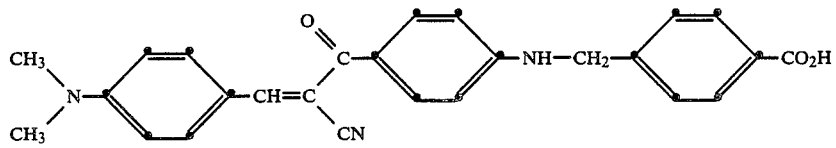
(6)
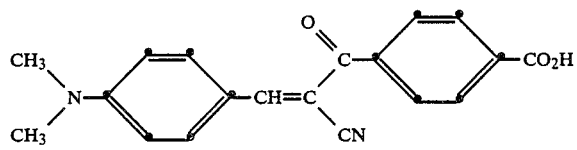
(7)
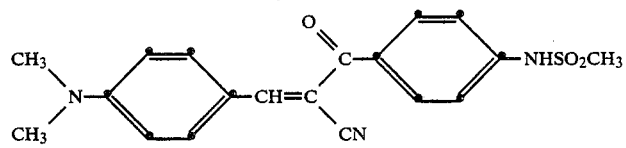
(8)
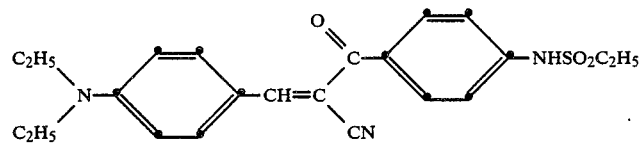
(9)
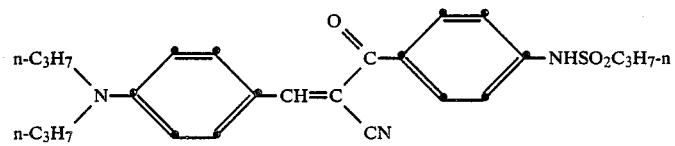
(10)
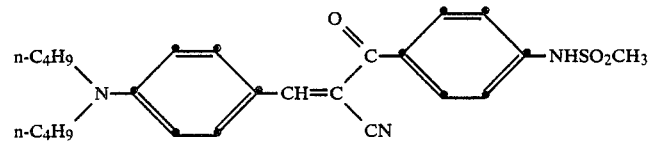
(11)
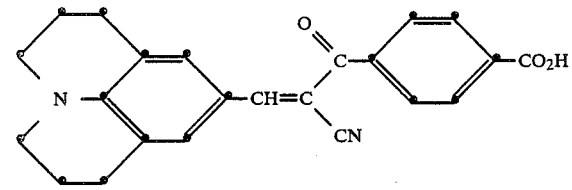

-continued
(12)
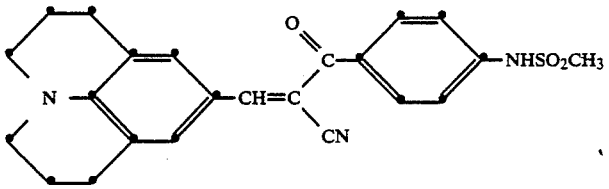
(13)
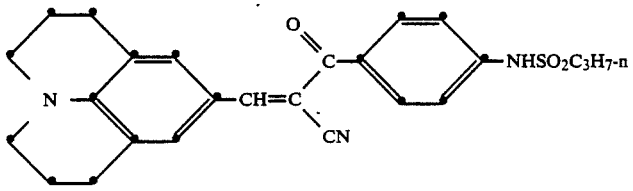
(14)
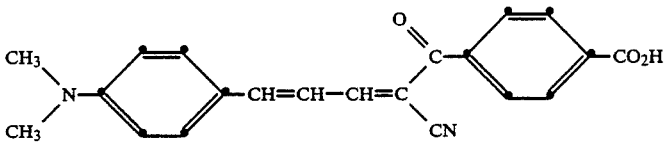
(15)
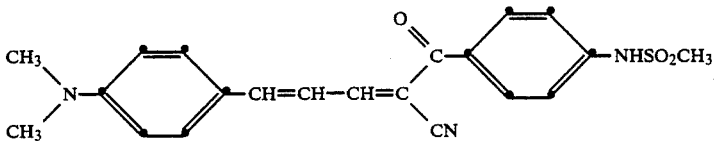
(16)
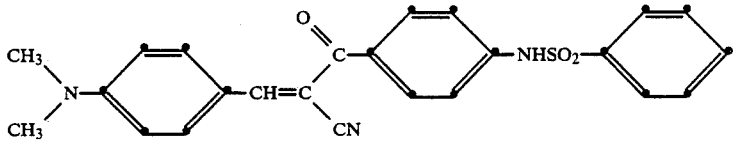
(17)
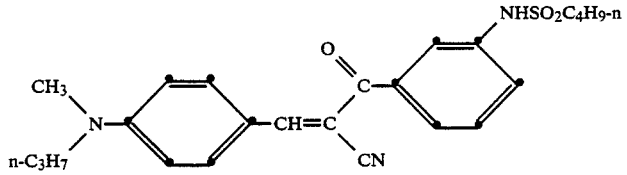
(18)
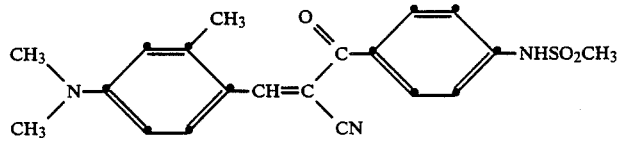
(19)
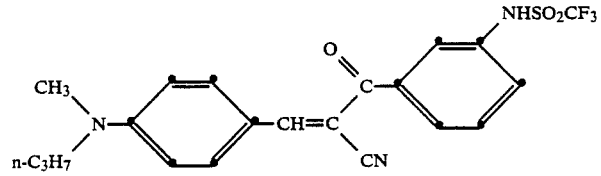
(20)
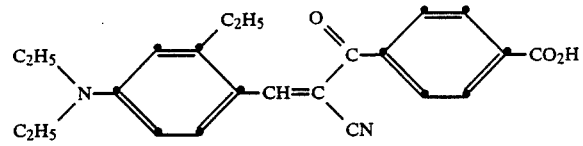

-continued

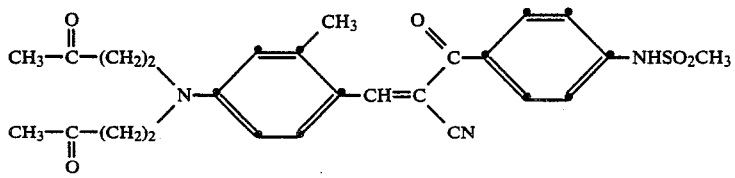

(21)

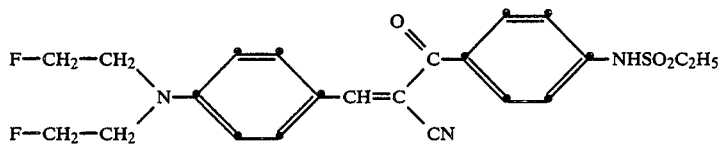

(22)

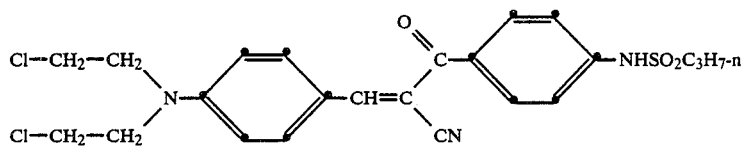

(23)

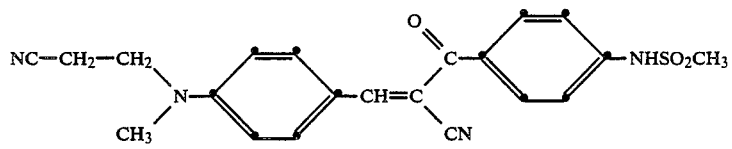

(24)

The dyes of formula (I) can be prepared by synthetic techniques well known in the art, as illustrated by the synthetic examples below. Such techniques are further illustrated, for example, in "*The Cyanine Dyes and Related Compounds*", Frances Hamer, Interscience Publishers, 1964.

The dyes of formula (I) are in the form of a solid particle dispersion (i.e., the dye is in the form of solid particles of microscopic size) for incorporation into a layer such as a hydrophilic colloid layer of a photographic element. The solid particle dispersion can be formed by precipitating the dye in the form of a dispersion and/or by well-known milling techniques, e.g., ball-milling, sand-milling, or colloid-milling (preferably ball-milling or sand-milling) the dye in the presence of a dispersing agent. The dye particles in the dispersion should have a mean diameter of less than 10 μm and preferably less than 1 μm. The dye particles can be conveniently prepared in sizes ranging down to about 0.01 μm.

The dyes may be located in any layer of the element where it is desirable to absorb light, but it is particularly advantageous to locate them in a layer where they will be solubilized and washed out during processing. Useful amounts of dye range from 1 to 1000 mg/m$^2$. The dye should be present in an amount sufficient to yield an optical density at the absorbance D-max in the visible region before processing of at least 0.10 density units and preferably at least 0.50 density units. This optical density will generally be less than 5.0 density units for most photographic applications.

The support of the element of the invention can be any of a number of well-known supports for photographic elements. These include polymeric films such as cellulose esters (e.g., cellulose triacetate and diacetate) and polyesters of dibasic aromatic carboxylic acids with divalent alcohols (e.g., poly(ethylene terephthalate)), paper, and polymer-coated paper. Such supports are described in further detail in *Research Disclosure*, December, 1978, Item 17643 [hereinafter referred to as *Research Disclosure*], Section XVH.

The radiation-sensitive layer of the element of the invention can contain any of the known radiation-sensitive materials, such as silver halide, diazo image-forming systems, light-sensitive tellurium-containing compounds, light-sensitive cobalt-containing compounds, and others described in, for example, J. Kosar, Light-Sensitive Systems: Chemistry and Application of Non-silver Halide Photographic Processes, J. Wiley & Sons, N.Y. (1965). Radiation-sensitive materials exhibiting sensitivity to blue light and especially those sensitive to blue light and at least some other wavelength of radiation are preferred, as the dyes according to the invention can be advantageously used to absorb some or all of the blue light.

Silver halide is especially preferred as a radiation-sensitive material. Silver halide emulsions can contain, for example, silver bromide, silver chloride, silver iodide, silver chlorobromide, silver chloroiodide, silver bromoiodide, or mixtures thereof. The emulsions can include coarse, medium, or fine silver halide grains bounded by 100, 111, or 110 crystal planes. Silver halide emulsions and their preparation are further described in *Research Disclosure*. Section I. Also useful are tabular grain silver halide emulsions, as described in *Research Disclosure*, January, 1983, Item 22534 and U.S. Pat. No. 4,425,426.

The radiation-sensitive materials described above can be sensitized to a particular wavelength range of radiation, such as the red, blue, or green portions of the visible spectrum, or to other wavelength ranges, such as ultraviolet, infrared, and the like. Sensitization of silver halide can be accomplished with chemical sensitizers such as gold compounds, iridium compounds, or other group VIII metal compounds, or with spectral sensitizing dyes such as cyanine dyes, merocyanine dyes, styryls, or other known spectral sensitizers. Additional information on sensitization of silver halide is described in *Research Disclosure*, Sections I–IV.

The dyes of formula (I) where n is 0 tend to absorb light in the blue portion of the spectrum, and are thus useful in many applications requiring the use of a blue-absorbing filter dyes. For example, they can be used as interlayer dyes, trimmer dyes, or antihalation dyes. They can be used to prevent crossover in X-ray materials, to prevent unwanted blue light from reaching the green-sensitive emulsion layer of a multicolor photographic element, and other uses as indicated by the absorbance spectrum of the particular dye. The dyes can be used in a separate filter layer or as an intergrain absorber.

Multicolor photographic elements according to the invention generally comprise a blue-sensitive silver halide layer having a yellow color-forming coupler associated therewith, a green-sensitive layer having a magenta color forming coupler associated therewith, and a red-sensitive silver halide layer having a cyan color-forming coupler associated therewith. Color photographic elements and color-forming couplers are well-known in the art and are further described in *Research Disclosure*, Section VII.

The element of the invention can also include any of a number of other well-known additives and layers, as described in *Research Disclosure*. These include, for example, optical brighteners, antifoggants, image stabilizers, light-absorbing materials such as filter layers or intergrain absorbers, light-scattering materials, gelatin hardeners, coating aids and various surfactants, overcoat layers, interlayers and barrier layers, antistatic layers, plasticizers and lubricants, matting agents, development inhibitor-releasing couplers, bleach accelerator-releasing couplers, and other additives and layers known in the art.

The dye of formula (I) can be located in any layer of a photographic element where it is desired to absorb light. In a preferred embodiment, the dye is preferably located in a layer where it will be subJected to high pH (i.e., 8 to 12) and/or sulfite during photographic processing, so as to allow the dye to be solubilized and removed or decolorized .

The photographic elements of the invention, when exposed, can be processed to yield an image. During processing, the dye of formula (I) will generally be decolorized and/or removed. Following processing, the dye of the invention should contribute less than 0.10 density unit, and preferably less than 0.02 density unit to the absorbance D-max in the visible region in the minimum density areas of the exposed and processed element.

Processing can be by any type of known photographic processing, as described in *Research Disclosure*. Sections XIX–XXIV, although it preferably includes a high pH (i.e., 8 or above) step utilizing an aqueous sulfite solution in order to maximize decolorization and removal of the dye. A negative image can be developed by color development with a chromogenic developing agent followed by bleaching and fixing. A positive image can be developed by first developing with a non-chromogenic developer, then uniformly fogging the element, and then developing with a chromogenic developer. If the material does not contain a color-forming coupler compound, dye images can be produced by incorporating a coupler in the developer solutions.

Bleaching and fixing can be performed with any of the materials known to be used for that purpose. Bleach baths generally comprise an aqueous solution of an oxidizing agent such as water soluble salts and complexes of iron (III) (e.g., potassium ferricyanide, ferric chloride, ammonium of potassium salts of ferric ethylenediaminetetraacetic acid), water-soluble persulfates (e.g., potassium, sodium, or ammonium persulfate), water soluble dichromates (e.g., potassium, sodium, and lithium dichromate), and the like. Fixing baths generally comprise an aqueous solution of compounds that form soluble salts with silver ions, such as sodium thiosulfate, ammonium thiosulfate, potassium thiocyanate, sodium thiocyanate, thiourea, and the like.

The invention is further illustrated by the following Examples:

EXAMPLE 1

Dye 1 was prepared as a solid particle dispersion by ball-milling according to the following procedure. Water (21.7 ml) and a 6.7% solution of Triton X-200 ® surfactant (2.65 g) were placed in a 60 ml screw-capped bottle. A 1.00 g sample of dye was added to this solution. Zirconium oxide beads (40 ml, 2 mm diameter) were added and the container with the cap tightly secured was placed in a mill and the contents milled for four days. The container was removed and the contents added to a 12.5% aqueous gelatin (8.0 g) solution. The new mixture was placed on a roller mill for 10 minutes to reduce foaming and the resulting mixture was filtered to remove the zirconium oxide beads. The resulting dye dispersion had no particle with a mean diameter over 1.0 μm.

The solid particle dispersion of Dye 1 was coated in a photographic element having the following format:

| | |
|---|---|
| Bis-vinylsulfonyl methyl ether | (203 mg/m$^2$) |
| Gelatin | (1356 mg/m$^2$) |
| Yellow Dye-forming Coupler C-1 | (753 mg/m$^2$) |
| Gelatin | (1076 mg/m$^2$) |
| AgBrI (12% I, 3-D grains, 1.8μ) | (1615 mg Ag/m$^2$) |
| Sensitizing Dye SD-1 | (2.9 mg/m$^2$) |
| 5-methyl-5-triazole-[2-3-a]-pyrimidine-7-ol, Na salt | (26 mg/m$^2$) |
| Gelatin | (1076 mg/m$^2$) |
| Gelatin | (1076 mg/m$^2$) |
| Dye 1 | (215 mg/m$^2$) |
| Magenta Dye-Forming Coupler C-2 | (646 mg/m$^2$) |
| Gelatin | (1076 mg/m$^2$) |
| AgBrI (4% I, T-grain, 3.6 × 0.14μ) | (1615 mg Ag/m$^2$) |
| Sensitizing Dye SD-2 | (1.8 mg/m$^2$) |
| Sensitizing Dye SD-3 | (6.1 mg/m$^2$) |
| 5-methyl-5-triazole-[2-3-a]-pyrimidine-7-ol, Na salt | (52 mg/m$^2$) |
| Gelatin | (1076 mg/m$^2$) |

-continued

| Gelatin | (4887 mg/m$^2$) |
|---|---|

C-1

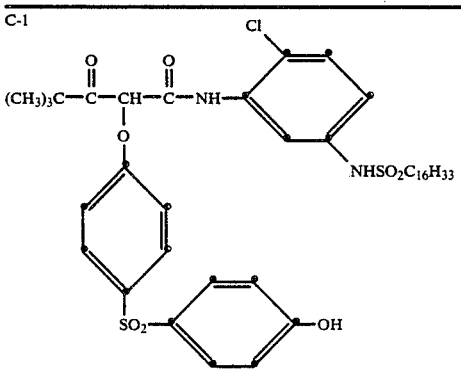

C-2

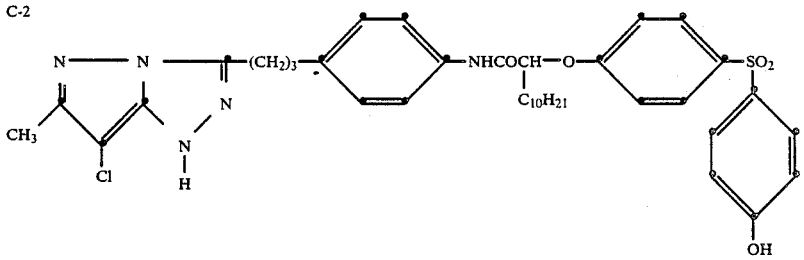

SD-1

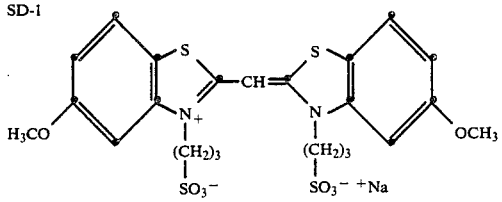

SD-2

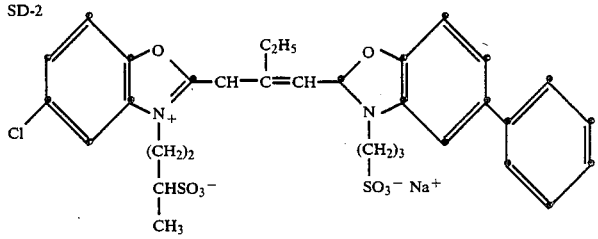

SD-3

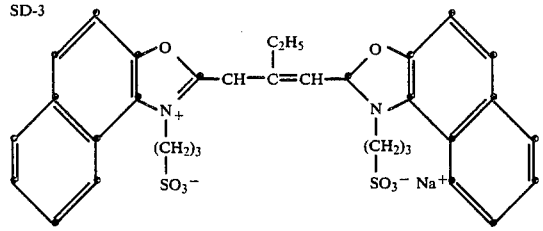

As a comparison, identical elements were prepared except that Dye 1 was in the form of a dispersion having large particle sizes (having numerous particles larger than 1.0 μm) prepared by dissolving the dye in a small amount of cyclohexanone and mixing with aqueous gelatin, water, and a surfactant, or in a loaded latex dispersion of particles of poly(methyl acrylate-co-1 propane sulfonic acid, 2 methyl 2 [(1 oxo 2 propenyl-)amino]co-butanoic acid, 3 oxo 2 [(2 methyl 1 propenyl-)oxy]ethyl ester) (89.6:3.7:6.7).

The elements were exposed to a test image using a simulate daylight light source and processed using Kodak C-41 ® processing. The blue-green separation of each of the elements was measured by calculating the difference in relative speeds between the blue-sensitive layer and the green-sensitive layer (with the green-sensitive layer having a speed of 100). A larger value for the blue-green separation indicates more effective filtering by the filter dye. The blue-green separation values along with the percent absorbance at λ-max of the filter dyes are presented below in Table I.

TABLE I

| Dye | Blue-Green Separation | % Absorbance at λ-Max |
|---|---|---|
| Comparison Dye 1 (large particle dispersion) | 307 | 17.3 |
| Comparison Dye 1 (loaded | 462 | 37.3 |

TABLE I-continued

| Dye | Blue-Green Separation | % Absorbance at λ-Max |
|---|---|---|
| polymer latex) Invention Dye 1 (solid particle dispersion) | 855 | 82.0 |

Both the absorbance and blue-green separation values presented in Table I show significantly greater filtering efficiency for Dye 1 in solid particle dispersion form than as a loaded latex or as a large particle dispersion.

EXAMPLES 2–7

Solid particle dispersions of dyes 1–6 prepared as in Example 1 were coated on polyester supports according to the following procedure. A spreading agent (surfactant 10G ®) and a hardener (bis(vinylsulfonylmethyl) ether) were added to the dye gelatin melt prepared as described above. A melt from this mixture was then coated on a poly(ethylene terephthalate) support to achieve a dye coverage of 0.32 g/m$^2$, a gelatin coverage of 1.60 g/m$^2$, a spreading agent level of 0.096 g/m$^2$, and a hardener level of 0.016 g/m$^2$. The absorbance of the dye dispersions was measured with a spectrophotometer. Identical elements were subjected to a 5 minute distilled water wash, to Kodak E-6 ® Processing (which is described in *British Journal of Photography Annual*, 1977, pp. 194–97) and the absorbance was measured for each. The results are presented below in Table II.

TABLE II

| Dye | λ-max (nm) | Band-width (nm) | D-max | D-max after water Wash | D-max After E-6 ® Processing |
|---|---|---|---|---|---|
| 1 | 432 | 83 | 1.43 | 1.43 | 0.01 |
| 2 | 441 | 114 | 0.90 | 0.89 | 0.01 |
| 3 | 457 | 76 | 0.99 | 1.01 | 0.01 |
| 4 | 439 | 92 | 0.79 | 0.82 | 0.02 |
| 5 | 498 | 117 | 1.95 | 1.95 | 0.02 |
| 6 | 521 | 106 | 1.29 | 1.24 | 0.01 |

The results presented in Table I show that the dyes 1–6 according to the invention are no affected by the water wash, indicating no wandering at coating pH, but are fully solubilized for removal and/or decolorization by the photographic processing to which they were subJected.

The invention has been described in detail with reference to preferred embodiments thereof. It should be understood, however, that variations and modifications can be made within the spirit and scope of the invention.

What is claimed is:

1. A photographic element comprising a support having thereon a radiation-sensitive silver halide emulsion layer and layer, which is the same as or different from the silver halide layer, comprising a hydrophilic binder and an amount effective as a photographic filter dye of a dispersion of solid particles having mean diameters of from about 0.01 to 10 μm, said particles consisting essentially of a compound having the formula:

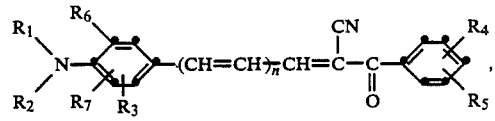

wherein n is 0 or 1, $R_1$ and $R_2$ each independently represents substituted or unsubstituted alkyl or substituted or unsubstituted aryl, or taken together with $R_6$, $R_7$, N, and the atoms to which they are attached, represent the atoms necessary to complete a julolydyl ring, $R_3$ is H, substituted or unsubstituted alkyl, or substituted or unsubstituted aryl, $R_4$ and $R_5$ each independently represents H, substituted or unsubstituted alkyl, substituted or unsubstituted aryl, secondary or tertiary amino, $CO_2H$, or $NHSO_2R_8$, with the proviso that at least one of $R_4$ and $R_5$ or a substituent on an aryl ring in $R_4$ or $R_5$ is $CO_2H$ or $NHSO_2R_8$, $R_6$ and $R_7$ each independently represents H, or $R_7$ taken together with $R_2$, or $R_6$ taken together with $R_1$, represent the atoms necessary to complete a carbocyclic ring, and $R_8$ is substituted or unsubstituted alkyl or substituted or unsubstituted aryl.

2. A photographic element according to claim 1 wherein $R_1$ and $R_2$ are each indePendently substituted or unsubstituted alkyl of from 1 to 6 carbon atoms or substituted or unsubstituted aryl of from 6 to 12 carbon atoms, $R_3$ is H, substituted or unsubstituted alkyl of from 1 to 6 carbon atoms, or substituted or unsubstituted aryl of from 6 to 12 carbon atoms, $R_4$ and $R_5$ each independently represents H, substituted or unsubstituted alkyl of from 1 to 6 carbon atoms, substituted or unsubstituted aryl of from 6 to 12 carbon atoms, secondary or tertiary amino having from 1 to 12 carbon atoms, $CO_2H$, or $NHSO_2R_8$. with the proviso that at least one of $R_4$ and $R_5$ or a substituent on an aryl ring in $R_4$ or $R_5$ is $CO_2H$ or $NHSO_2R_8$, $R_6$ and $R_7$ are each H, and $R_8$ is substituted or unsubstituted alkyl of from 1 to 6 carbon atoms or substituted or unsubstituted aryl of from 6 to 12 carbon atoms.

3. A photographic element according to claim 1 wherein $R_4$ is $NHSO_2R_8$ and $R_5$ is H or $NHSO_2R_8$.

4. A photographic element according to claim 1 wherein $R_4$ is $CO_2H$ and $R_5$ is H or $CO_2H$.

5. A photographic element according to claim 1 where $R_8$ is alkyl of from 1 to 3 carbon atoms.

6. A photographic element according to claim 5 wherein $R_8$ is methyl.

7. A photographic element according to claim 1 wherein at least one of $R_1$ and $R_2$ is terminated with $$R_9OC(=O)-\quad \text{or} \quad R_9CO(=O)-,$$

wherein $R_9$ is alkyl of 1 to 3 carbon atoms or fluoroalkyl of 1 to 3 carbon atoms.

8. A photographic element according to claim 7 wherein $R_8$ is alkyl of from 1 to 3 carbon atoms.

9. A photographic element according to claim 8 wherein $R_8$ is methyl.

10. A photographic element according to claim 1 wherein n is 0.

* * * * *

UNITED STATES PATENT AND TRADEMARK OFFICE

CERTIFICATE OF CORRECTION

PATENT NO. : 4,950,586

DATED : August 21, 1990

INVENTOR(S) : Diehl et al

It is certified that error appears in the above-identified patent and that said Letters Patent is hereby corrected as shown below.

Column 13, line 67 "10 μm", should read - - 1 μm - -

Signed and Sealed this

Thirty-first Day of December, 1991

*Attest:*

HARRY F. MANBECK, JR.

*Attesting Officer*

*Commissioner of Patents and Trademarks*